United States Patent [19]

Fishback

[11] Patent Number: 4,778,094

[45] Date of Patent: Oct. 18, 1988

[54] NAIL AND DIMPLER DRIVING APPARATUS FOR NAILING GUN

[75] Inventor: Gary M. Fishback, Santa Barbara, Calif.

[73] Assignee: The Dimpling Nailing Gun Company, Santa Barbara, Calif.

[21] Appl. No.: 104,443

[22] Filed: Oct. 2, 1987

[51] Int. Cl.[4] ..... B25C 1/04

[52] U.S. Cl. ..... 227/66; 227/120; 227/132; 227/139; 227/140; 227/150

[58] Field of Search ..... 227/7, 8, 2, 66, 116, 227/117, 120, 150, 130, 135, 139, 140

[56] References Cited

U.S. PATENT DOCUMENTS

| | | | |
|---|---|---|---|
| 2,918,675 | 12/1959 | Smith | 227/66 |
| 3,027,560 | 4/1962 | Nelson | 227/66 |
| 3,040,327 | 6/1962 | Michel | 227/130 X |
| 3,434,643 | 3/1969 | Wandel | 227/130 |
| 3,774,293 | 11/1973 | Golsch | 227/66 X |
| 4,341,336 | 7/1982 | Smith | 227/66 |
| 4,566,619 | 10/1984 | Kleinholtz | 227/8 |
| 4,573,623 | 3/1986 | Sexton, Jr. et al. | 227/66 |
| 4,610,381 | 9/1986 | Kramer | 227/7 |
| 4,611,739 | 9/1986 | Rowton | 227/156 X |
| 4,666,074 | 5/1987 | MacDonald | 227/66 |

OTHER PUBLICATIONS

Hitachi—Pneumatic Nailer, Type VH-500, Instruction Manual.

*Primary Examiner*—Paul A. Bell
*Attorney, Agent, or Firm*—Joseph R. Jordan

[57] ABSTRACT

A nail and dimpler driving apparatus for a nailing gun is provided having a barrel with a short hardened metal dimpler which slides longitudinally in the end of the barrel and comprises a hardened metal piston having a broadened face at its end extending symmetrically on opposite sides of a metal plunger which extends longitudinally from the lower center of the piston face in alignment with an orifice through the dimpler. The piston reciprocates to impact a shoulder at the inner end of the dimpler. The barrel has a longitudinal rail extending along the top of its bore to maintain the piston and dimpler in angular alignment and to guide nails fed into the bore from an opening located in the side of the barrel between the tip of the retracted plunger and the dimpler shoulder. The rail has a longitudinal groove in its lower edge to aid in guiding the nails and in providing clearance for the residue of web material used to join the nails in flexible collated strips.

19 Claims, 2 Drawing Sheets

NAIL AND DIMPLER DRIVING APPARATUS FOR NAILING GUN

The present invention relates to nailing guns and, more particularly, to nail driving and surface dimpling apparatuses for nailing guns, especially those of the single stroke type.

Nailing guns are labor saving tools which are finding increasingly widespread use in the construction industry Generally, these guns are hand held electrically or pneumatically driven machines for driving fasteners to secure one piece of construction material to another, usually to secure sheet material to structural or framing members such as to wooden studs and joists in building construction. The most common designs for nailing guns provide a barrel from which a reciprocating piston drives the fasteners one by one into the materials as the fasteners are fed sequentially from a magazine.

Typically, these guns employ electric or pneumatic reciprocating piston-like elements having remote plunger or hammer surfaces which, when driven, will hammer the nails or fasteners into the material, either in a single, or a series of piston strokes. The pneumatic nailing guns operate with a pressurized air supply which is connected to the gun through an air hose. In these guns, the pressurized air is intermittently applied to an air cylinder in response to the operation by a worker of a manual trigger, causing a reciprocating piston in the cylinder to advance and drive the plunger, delivering the fastener to the material.

It is standard in the nailing gun art that the guns be provided with a supply of fasteners from a magazine which communicates with the barrel of the nailing gun. Such guns employ a feed mechanism which operates in coordination with the trigger and piston to feed the fasteners one at a time into the barrel and into the path of the piston plunger. In the gun barrel, the fastener tips are oriented toward an opening in the end of the barrel through which the nails are driven into the material.

The present invention does not relate to the features of the piston actuating or fastener feeding portions of these guns. Various designs for these features have been provided and are disclosed in the publications of the prior art, included in the patents referred to above, which designs may be employed in guns which embody features of the present invention.

The use of these nailing guns has been proposed to secure sheet material of the type known as drywall, wallboard or plasterboard to framing members in home and office construction. This application requires, in addition to the step of driving a fastener into the materials, the step of forming a depression in the surface of the drywall at and around the head of the fastener. The depression in the surface of the sheet material is provided to recess the nail and the surrounding area so that the nail head can be completely covered with the application of drywall compound to hide the nail for the finishing of the wall surface.

This depression or "dimple" has been historically formed manually by a worker with the use of a dull hammer specially suited for that purpose, or with a power dimpling tool. The separate dimpling step, however, introduces error in the placement and the depth of the dimple, particularly when manually performed. Such errors result in insufficient coverage of the nail head when the drywall compound is applied, or in a crushing of the drywall core or a tearing of the paper surface of the wallboard which results in a weakening of its connection to the frame. To reduce such errors and to extend labor saving techniques to the dimple forming operation, several prior art proposals have been made to provide dimpling mechanisms on nailing guns so that the nail driving and surface dimpling operations can be performed together.

With the dimple formed with a "dimpler" mechanism on the gun, however, the prior art has sought to achieve a greater capability for reducing nail driving and dimple forming errors. The prior art efforts have, however, been less than successful. The lack of uniformity of wood framing materials due to variations in hardness, knot content, etc., requires a reserve of force and energy in the nail driving stroke to overcome the more resistive material variations. The relative fragility of the drywall material, however, will not easily tolerate excess force and energy which has not been dissipated in driving the nail.

Examples of nailing guns of the prior art, including those having dimpler mechanisms, are disclosed in U. S. Pat. Nos. 2,918,675 to Smith, 3,027,560 to Nelson, 3,040,327 to Michel, 3,774,293 to Golsch, 4,341,336 to Smith, 4,566,619 to Kleinholz, and 4,610,381 to Kramer. The disclosures of these patents and those cited thereby are incorporated by reference herein.

In the patents on the prior art nailing guns referred to above, dimpler mechanisms are also disclosed. These mechanisms each characteristically includes a dimpler component which is moveably carried either internally or externally by the barrel of the nailing gun. The dimpler surrounds the nail delivery orifice at the discharge end of the nailing gun barrel. This dimpler has a broad, usually concave surface surrounding the nail emitting orifice which functions to form a dimple in the surface of the sheet material when an impulse or series of impulses from the nailing gun are delivered to the dimpler to drive it against the surface of the sheet material. It is to the piston and barrel design, and to the interrelation of the design of these components with the dimpler and nail driving features of the mechanism, which the present invention relates.

The automatic dimpling devices in nailing guns of the prior art do not consistently function to form around the driven nail an impression in the sheet material of predetermined depth and shape without overdriving the nail so as to tear the paper cover of the drywall material and without crushing the plasterboard core. Accordingly, they have not had widespread use. In the prior art attempts to solve the problems the guns have experienced, it has been recognized that direct metal to metal contact between the driving piston and the dimpler lends itself to a design which can be made to produce a more accurate control of the drywall depression. See for example, the discussion in the U.S. Pat. No. 3,774,293 to Golsch. This patent, however, recognizes the accompanying disadvantages experienced by prior art guns which use metal to metal impact to drive the dimpler as suffering increased component stresses and more rapid part failure and wear; these disadvantages having been previously overcome at the cost of increased weight or undesirable recoil. On the other hand, elimination of these disadvantages by utilizing resilient members to eliminate the metal to metal impact, while reducing component wear and part failure to some degree, does so at the cost of reduced control over the dimpling function, a reduction in overall performance which has been responsible for the slow acceptance of dimpling nailing guns by the industry.

Many of the recent gun designs of the prior art provide means to overcome some of the disadvantages of other prior art guns, such as providing mechanisms for reducing recoil, but these do so with unduly complicated and expensive designs. The prior art still is characterized by guns which do not provide effective reliable operation, providing instead various combinations of compromises of prior art deficiencies.

It is an objective of the present invention to provide a nail driving and surface dimpling mechanism which can be employed in nailing guns of a variety of conventional designs. It is a more particular objective of the present invention to provide a nail driving and surface dimpling mechanism which will function to form around the driven nail an impression in the sheet material of predetermined depth and shape, giving a high degree of control in the formation of the dimple, without overdriving the nail so as to tear the paper cover of the drywall material or crushing the plasterboard core, and which will do so without causing excessive component wear or adding excessive weight to the gun or recoil to the gun's operation.

It is a further objective of the present invention to provide a nail driving and surface dimpling mechanism which is not unduly complicated and expensive in design, but which will provide effective and reliable operation.

It is an additional objective of the present invention to provide a nail driving and surface dimpling apparatus for a nailing gun which accomplishes the above objectives while controlling the extent of the formed dimple and the driven depth of the nail, even where the operator fails to align the nail with a framing member, and, accordingly, avoiding the danger which would result if the nail were driven through the wall.

The present invention provides a nail driving and surface dimpling mechanism having a single stroke reciprocating piston which advances a nail through a dimpling member to drive the nail into the sheet material until the head of the piston is flush with surface of the material and with the outer convex surface of the dimpler, whereupon the piston solidly engages the dimpler and delivers a impulse thereto which dimples the material and simultaneously countersinks the nail.

According to the principles of the present invention, this and the above objectives are accomplished with a two section single stroke piston having a larger diameter portion which terminates in a broad abutment shoulder which serves as a hammer to effectively transfer energy to and solidly drive the dimpler. This piston has a smaller diameter portion eccentrically aligned on the piston shoulder and which, when fully advanced, extends through the dimpler bore the exact length thereof to serve as a hammer to drive the nail into the sheet material with its head flush with the surface of the sheet material. The shoulder on an oversize portion of the piston impacts the dimpler in close proximity to the surface of the drywall material in a metal to metal contact over a broad surface area at the inner end of the dimpler surrounding the nail delivering orifice. Upon impacting the dimpler, the piston is deaccelerated by contact between the piston head and a hard resilient stop, limiting the piston's ability to drive the dimpler further into the material than the impulse from the initial contact will carry it, preventing an overdriving of the nail as well as an over depression of the dimple.

The present invention makes the above features possible through the provision of a novel nail and piston guiding arrangement to accurately receive and align the automatically fed nails while allowing the effective contact between the piston shoulder and the dimple. The mechanism includes an axial rail positioned within the barrel which fits in a groove in the enlarged portion of the piston to stabilize the eccentric piston against rotation in the barrel and to guide and align the nails in the barrel bore with the dimpler orifice and allowing the enlarged piston portion to pass without interference to contact the dimpler near the end of the barrel.

These and other objectives, advantages and features of the present invention will be more readily apparent from the following detailed description of the drawings in which.

Figure 1:
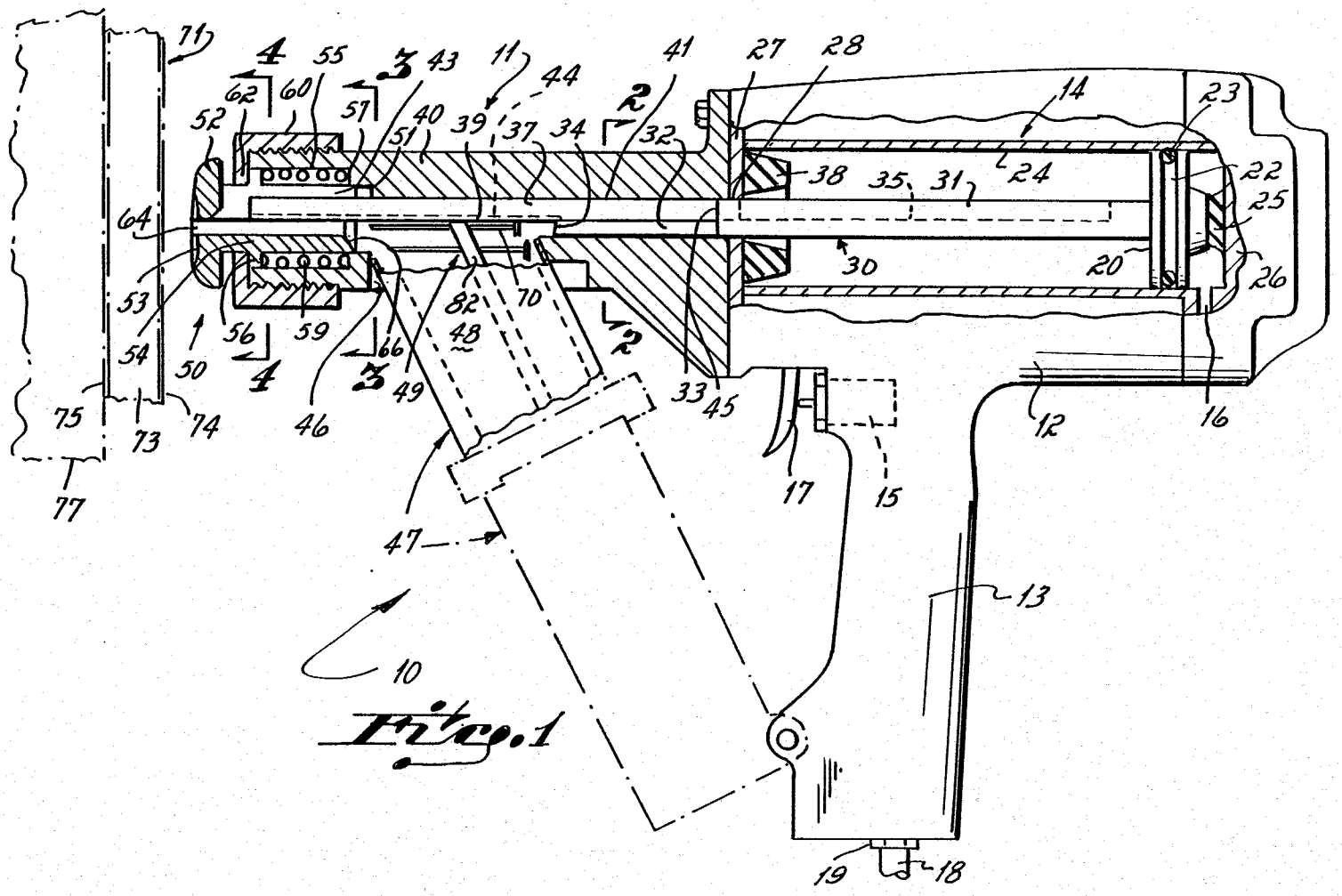
FIG. 1 is a side view, partially broken away and in cross-section, of a nailing gun which is provided with one preferred embodiment of a nail driving and surface dimpling apparatus according to principles of the present invention.

Referring to FIG. 1, a nailing gun 10 equipped with one preferred embodiment of a nail driving and surface dimpling mechanism 11 according to the present invention is illustrated. The gun 10 includes a housing 12 having a handle 13 formed integrally thereof.

The gun 10 of the illustrated embodiment is of the pneumatic type having a pneumatic cylinder 14 mounted within the housing 12 and responsive to the operation of a trigger actuated pneumatic valve assembly 15 carried by the handle 13. The handle 13 is configured in a conventional pistol grip arrangement. The assembly 15 operates to selectively apply pressurized air at an air inlet port 16 in the cylinder 14. The air is supplied, upon the actuation of a trigger 17 pivotally mounted on the handle 13, from a pressurized air hose 18 connected between an air inlet connector 19 in the handle 13 and an air compresser (not shown).

Details of pneumatic designs for the valve assembly 15 and for various configurations of air passages for operation of cylinders such as the cylinder 14 in nailing guns are shown and described in U.S. Pat. Nos. 2,918,675 to Smith, 3,040,327 to Michel, 3,434,643 to Wandel, and 3,774,293 to Golsch. The pneumatics discribed in these patents show means for driving and controlling the motion of the piston portion of the cylinder 14 for causing a piston to reciprocate by advancing in one direction when the trigger 17 is depressed and then to return either upon release of the trigger 17 or upon completion of the advancing stroke.

The cylinder 14 has slidably mounted to reciprocate axially therein a cylindrical pneumatic piston head 20. About the piston head 20 is an annular groove 22 in which is fitted a circular "O"-ring 23 which forms a pneumatically tight seal between the moveable piston head 20 and a cylindrical tube which forms the wall 24 of the cylinder 14. An elastic stop 25 is mounted at the center of a cylinder head 26 which is bolted onto the back end of the cylinder 14 to form a pneumatically tight seal with the wall 24 of the cylinder 14. Across the forward end of the cylinder 14 is an end plate 27 rigidly connected at the forward rim of the cylinder wall 24. The plate 27 has a circular hole 28 therein centered on the axis of the cylinder 14.

Rigidly secured at the forward end of the piston head 20 and extending axially therefrom is a piston rod 30. The piston rod 30 is machined of a hardened metal into two portions, a rearmost portion 31, referred to below as the piston, and forward portion 32, referred to as the plunger, each which are of circular cross-section. The larger rearmost portion 31 of the piston 30 is of circular cross-section of the same nominal diameter as that of the hole 28 in the plate 27 at the forward end of the cylinder 14 and extends therethrough, being positioned concentric with the axes of the cylinder 14 and the piston head 20. The forward end of the piston 31 lies ahead of the hole 28 in the plate 27 and terminates in a planar forward end 33 having a circular outer boundary.

Figure 2:
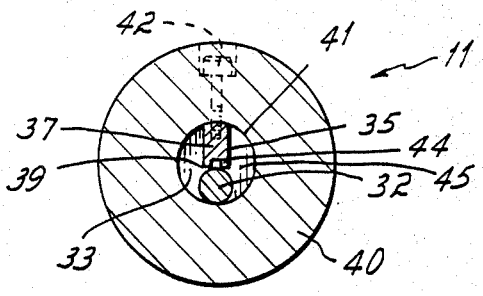
FIG. 2 is a cross-sectional view along line 2—2 of FIG. 1. through the barrel, rail and plunger facing toward piston.

Machined from the same piece of hardened metal as the rear piston 31 is the smaller forward portion of the piston rod 30, the plunger 32. The cross-section of the plunger 32 is a solid circle of a diameter approximately half that of the piston 31, and is positioned eccentrically on the forward end 33 of the piston 31 between its center and lower edge as illustrated in FIG. 2. The plunger 32 extends forward from the end 33 of the piston 31 on an axis parallel to that of the piston 31. The plunger 32 terminates in a flat tip 34. The tip 34 functions as the head of a hammer for driving the fasteners. This plane of the tip 34 is not exactly perpendicular to the axes of the piston 31 and plunger 32, but is inclined at a slight angle, approximately five degrees, upwardly toward the axis of the piston 31. Thus the shape of the tip 34 is slightly eliptical.

The piston 31 has a rectangular channel 35 extending longitudinally along one edge thereof and lying on a radius of the piston's cross-section diametrically across from the plunger 32 as illustrated in the cross-sectional view of FIG. 2. The channel 35 is shaped and dimensioned to fit around and slidably engage a linear rail 37 of rectangular cross-section which is fixed relative to the cylinder 14. The channel 35 extends along the piston 31 from the end 33 almost to the piston head 20 at the other end of the piston rod 30.

Figure 6:
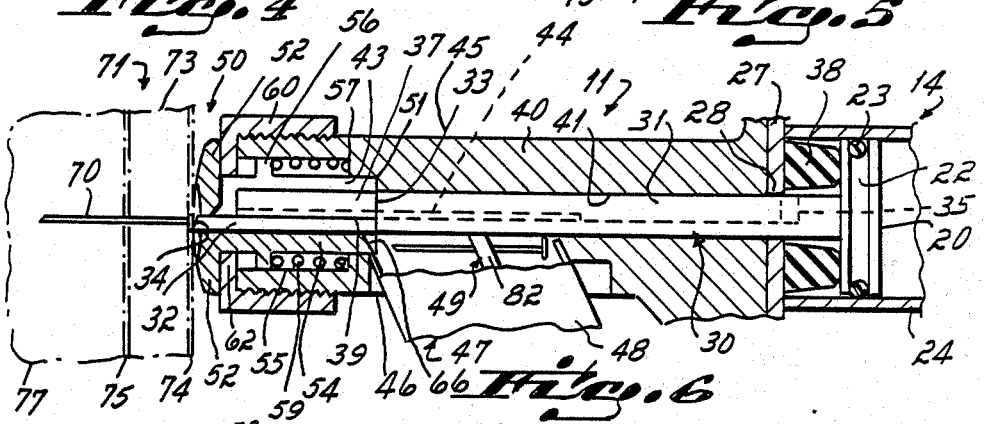
FIG. 6 is a cross-sectional side view similar to FIG. 5 illustrating the piston and plunger advanced to where a nail has been driven into the sheet material with its head flush with the surface of the sheet immediately prior to advancement of the dimpler.

The piston rod 30 is moveable with the piston head 20 which is slidable in the cylinder 14 from a retracted position, the position illustrated in FIG. 1, to an extended position at which the piston head 20 rests against an annular stop 38, as shown in FIG. 6. The stop 38 is molded of an elastomeric material and surrounds the piston rod 30 and the hole 28 on plate 27. The stop is securely fastened to the plate 27 in the interior of the cylinder 14 at the forward end thereof. The stop 38 functions to limit the forward extension of and to deaccelerate the piston head 20 and the piston rod 30 at the end of its forward stroke as is explained more fully below. The rail 37 extends forward from the plate 27 in the channel 35 of the piston 31, and has a lower edge 39 approximately on the axis of the piston rod 30 and against or in close proximity to the upper side of the plunger 32.

As illustrated further in FIG. 1, rigidly secured to the plate 27 at the forward end of the cylinder 14 and extending longitudinally therefrom is a cylindrical metal barrel 40 having an axial shaft 41 of circular cross-section machined therethrough. The shaft 41 is concentric with, and of the same nominal diameter as, the hole 28 in the plate 27 at the forward end of the cylinder 14. Secured rigidly to the inside surface of the shaft 41 with recessed allen head machine screws 42 is the rail 37. The screws 42 extend through the wall of the barrel 40 from along the top side to hold the rail 37 tightly in alignment along the top side of the shaft 41. The rail 37, so arranged, locks the piston rod 30 against rotation in the shaft 41 and forms a guide which cooperates with the opposite inner surface of the shaft 41 opposite the rail 37 to guide and confine the movement of the plunger 32 for longitudinal movement in the shaft 41.

Referring to FIG. 2, it can be seen that a U-shaped bore 43 is defined by the inner wall of the shaft 41 which is circular in cross-section and the rail 37 which has a rectangular cross-section extending radially upward from the center of the shaft 41. The piston 31 and plunger 32 are thus constrained for longitudinal movement along this U-shaped bore 43. As can be further seen, the cross-section of the plunger 32 spans the narrow portion of the bore 43 across the base of the U, between the opposing side defined by the lower edge 39 of the rail 37 and the lower side of the bore 43, forming a track for the longitudinal reciprocating movement of the plunger 32 in the bore 43.

Figure 4:
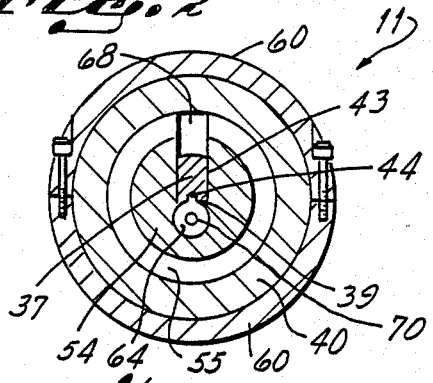
FIG. 4 is a cross-sectional view along line 4—4 of FIG. 1 through the barrel and dimpler facing toward the end of the barrel.

The rail 37 has extending axially along the lowe inner edge 39 thereof a groove 44, the edges of which are in approximate contact with the plunger 32 and help to guide the plunger 32 in its reciprocating path centrally along the bore 43 (FIG. 4). The forward end 33 of the piston 31 is a hard flat metal surface or piston face 45, transverse or perpendicular to the bore 43 and symmetrically on both sides of the plunger 32. The piston face 45 spans the remainder of the cross-section of the bore 43 which is not occupied by the plunger 32.

Referring again to FIG. 1, the gun 10 has through the side wall of the barrel 40 a rectangular opening 46 through which fasteners, in this case nails, are fed one at a time from a magazine 47 into the center of the bore 43 immediately ahead of the tip 34 of the plunger 32. The nails are fed from the magazine 46 into the bore 43 by a feeder mechanism 48. When so fed, the upper edges of the heads of the nails are directed against the groove 44 on the edge 39 of the rail 37 and positioned in the path of the nail driving tip 34 of the plunger 32. Designs for magazines 47 and feeder mechanisms 48 are conventional, several types which are suitable and adaptable to guns 10 embodying the present invention being described in patents of the prior art. Some such magazines and feeders useful in guns which comprise nail driving and dimpling apparatuses are described, for example, in U. S. Pat. Nos. 3,774,293 to Golsch, 4,566,614 to Kleinholz, and 4,610,381 to Kramer. These mechanisms operate to sequentially feed individual nails or strips of nails joined by a separable web from a linear magazine through an opening in the side of a nailing gun barrel and into the barrel bore. These and other similar mechanisms discribed in these patents or those cited therein are adaptable by those skilled in the art to operate with the apparatus of the present invention.

The illustrated embodiment of the present invention employs a nail magazine 47 of the circular type which, together with a flexible belt of nails 49 and feeder mechanism 48, are manufactured by Hitachi Koki Co., Ltd., 2-6-2 Ohtemichi, Chiyodo-Ku, Tokyo 100, Japan, and sold in the United States for and with the Hitachi Type VH-500 Pneumatic Nailer. The circular fastener magazine used in the Hitachi VH-500 nailer has an advantage over those of the linear type in that it provides a larger and more compact supply of nails. The nail strips 49 for such a circular magazine 47 are formed of a series of nails joined by a flexible separable plastic or paper web to which they are attached at a slant so that the heads overlap for closer spacing. The flexible webs allow the strips to be coiled in a spiral in the circular magazine 47. The feeder 48 of the type used on the Hitachi VH-500 is in common use on guns of other manufacturers. It is a feeder of a type often referred to as a sewing machine feeder, because of its resemblance to the mechanism for feeding cloth material in a sewing machine. Such a feeder includes opposed pairs of rachet bars, spring biased toward each other, one of each pair being fixed to one side of the nail strip path and the other being reciprocatible along the other side of the path. In operation, as the moveable set of rachet bars advances, its teeth move the strip forward one nail, while the other set of bars is cammed out of the path of the nails as the ride against the slanted backs of the rachet teeth. As the nails pass the stationary bars, the teeth snap back into the path to catch the nail strip, while the moveable bars then retract with the slanted backs of their teeth sliding over the nails of the strip camming the moveable bars laterally away from the nail path, snapping back into the path as they retreat to behind the next nails of the strip.

At the end of the barrel 40 and positioned ahead of the opening 46 in the side of the barrel wall is a dimpler 50 formed of hardened metal. The dimpler 50 is fitted loosely in an enlarged cylindrical section or dimpler cavity 51 at the end of the barrel shaft 41, in the longitudinal extension of the bore 43 surrounding the end of the rail 37. The dimpler 50 is machined of hardened steel and has a round head 52 with a slightly concave outer dimpler surface 53. The dimpler 50 has a cylindrical body portion 54 of the same nominal diameter as the enlarged bore 51 so as to be loosely carried and easily slidable therein.

At the forward end of the enlarged shaft section 51 is a further cylindrical enlargment or spring cavity 55. Integrally formed on the dimpler 50 and surrounding the dimpler body 54 is an annular ring 56 of such diameter as to fit into and be slidable within the spring cavity 55. An annular rim 57 is formed in the barrel 40 as a step between the dimpler cavity 51 and the spring cavity 55. Within the spring cavity 55 surrounding the body 54 of the dimpler 50, and compressed between the ring 56 and a rim 57 at the inner end of the cavity 51, is a helical spring 59. The spring 59 biases the dimpler 50 to the full extended position illustrated in FIG. 1. A split retaining collar 60 is threaded onto the end of the barrel 40 to limit the outward motion of the dimpler 50 (FIG. 4). The collar 60 is manufactured in two halves and, in assembly, the halves are joined with two Allen head machine screws. The assembly of the collar 60 is done after the dimpler 50 is inserted into the cavity 51. In this way, the head 52 of the dimpler 50 can be larger than the collar 56 which must be smaller than the ring 56 to hold it in the barrel 40.

At the inner end of the dimpler 50 is a flat circular surface transverse to the shaft 41 of the barrel 40 forming a shoulder 62 at the inner end of the dimpler 50. In the performance of the dimpling step of the operating cycle of the mechanism 11, the shoulder 62 will be contacted by the piston face 45 on the end 33 of the piston 31 to drive the dimpler head 52 outward to dimple the sheet material.

Extending through the dimpler 50 from the shoulder 62 to the outer surface 53 of the dimpler head 52 is a circular orifice 64 axially aligned with the plunger 32 and of same nominal diameter, just large enough for plunger 32 to freely drive, through the orifice 64, fasteners which have been fed from the magazine 47 through the opening 46 and into the bore 43. The length of the orifice 64 of the dimpler 50 is nominally equal to the length of the plunger 32. Accordingly, when the surface 45 at the end 33 of the piston 31 is in engagement with the dimpler shoulder 62, the tip 34 of the plunger 32 is flush with the outer concave surface 53 of the head 52 of the dimpler 50 (FIGS. 6 and 7) so that the head of a nail, when driven, is flush with the surface of the dimpled sheet material.

Figure 3:
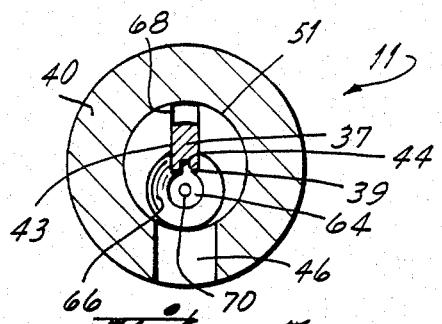
FIG. 3 is a cross-sectional view along line 3'3 of FIG. 1 the barrel facing the innermost end of the dimpler.

The shoulder 62 of the dimpler 50 has a beveled edge 66 surrounding the inlet of the orifice 64 to guide misaligned nails into the orifice 64. This is better illustrated in FIG. 3. As with the piston 31, the dimpler body 54 has, along its outer surface, diametrically aligned with and opposite the orifice 64, a rectangular channel 68 shaped to conform to the surface of the rail 37 to allow the dimpler to slide upon the rail 37 in the dimpler cavity 51 and maintain the angular alignment of the dimpler 50 with the piston 30 so that the orifice 64 is in precise alignment with the plunger 32 (FIG. 4).

The nail driving and surface dimpling mechanism 11 comprises primarily the piston rod 30, the barrel 40, the dimpler 50 and their related components and accessory parts as described above. It functions to drive a nail 70 which has been fed by feeder 48 from magazine 47 through sheet material such as drywall 71. The drywall material 71 is illustrated in the figures as a sheet of plaster 73 between two sheets of paper covering 74 and 75. The nails are driven to secure the sheet material 71 to framing members such as wood studs 77 in house and office construction. The operation and other structural details of the nailing gun 10 which embodies the invention can be better understood by reference to FIGS. 5 through 7.

Figure 5:
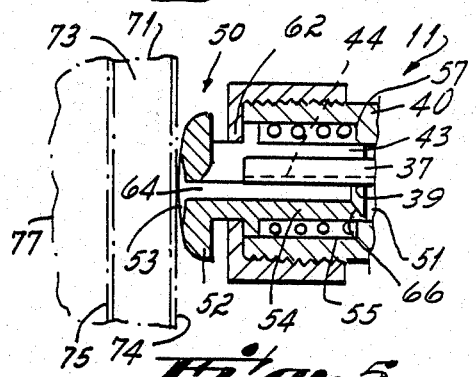
FIG. 5 is a cross-sectional side view illustrating the nail driving and dimpling apparatus portion of the gun of FIG. 1 with the dimpler depressed against the sheet material at the start of the nail driving portion of the operating cycle.

In operation, activation of the nail driving and dimpling mechanism 11 of the nail gun 10, begins with a depression of the dimpler 50 from its fully extended position illustrated in FIG. 1, in which ring 56 is against the back of the collar 60, to its fully retracted position as illustrated in FIG. 5, in which the dimpler head 52 is against the front of the collar 60. An operator accomplishes this by pressing the end of the barrel 40 against the surface of the drywall 71 to be nailed. As this is done, the body 54 of the dimpler 50 slides fully into the dimpler cavity 51 as the ring 56 compresses the spring 59 against the stepped rim 57. This brings the tapered edge 66 on the inner end of the dimpler orifice 64 around the tip of the nail 70 which is in the barrel bore 43 as shown in FIG. 5.

The depression of the dimpler 50 to its fully retracted position also releases a safety interlock (not shown) located in the barrel 40 to enable the trigger 17 and valve assembly 15 to activate the cylinder 14. The purpose of this interlock is to prevent the firing of the nailing gun 10 except when the tip of the barrel 40 is pressed against the sheet material 71 for nailing, so that a nail 70 will not be fired inadvertently or otherwise discharged in a manner likely to cause injury. Such safety interlock mchanisms are not new, but are becoming standard safety features for guns of this type. Such a safety mechanism is more fully described in U.S. Pat. No. 3,774,293 to Golsch. The mechanism of the illustrated gun 10 includes linkage (not shown) slidably mounted in wall of the barrel 40 and biased against the dimpler 50 so that when the dimpler 50 is depressed against the drywall material 71, an additional pneumatic valve in series with the valve assembly 15 is opened to allow the air supply from the hose 18 to the cylinder 14. In this way, activation of the valve assembly 15 will be rendered ineffective until the dimpler is depressed.

Once the dimpler 50 is depressed and the trigger 17 is enabled, the initiation of the nail driving portion of the cycle of the mechanism 11 occurs. This is illustrated in FIG. 6. The depression of the trigger 17 causes compressed air to be delivered from the air hose 18 at the port 19 in the handle 13 through the valve 15 and through the inlet port 16 into the high pressure chamber in the cylinder 14 between the piston head 20 and the cylinder head 26. This causes the piston head 20 to advance to drive the piston rod 30 through the shaft 41 in the barrel 40, and to bring the tip 34 plunger 32 into driving contact with the head of the nail 70. The slight angular upward slant of about five degrees of the plunger tip 34 effectively disengages the nail 70 from the web 82 which joins the nails together. It does so by applying a slight rotational force to tear the nail from the web 82. Any portion of the web 82 which remains on the nail however will simply be carried with the nail as it is driven with no ill effect to the nailing operation. The plunger 32 then continues to advance to direct the nail 70 through the orifice 64 in the dimpler 50 and into the drywall material 71. As the nail 70 proceeds through the orifice 64 under the driving force of the piston 30, it frictionally rides against the groove 44 of the rail 37 which causes the nail 70 to be guided and oriented properly as it advances. Misalignment of the nail which remains, if any, will be corrected by the tapered rim 66 on the shoulder 62 on the inner end of the dimpler 50 surrounding the dimpler orifice 64.

After the engaging of the nail 70 by the plunger 32, the piston 30 will advance until the tip 34 of the smaller piston portion 32 is flush with the surface 53 of the head 52 of the dimpler 50, whereupon the shoulder 45 at the end 33 of the piston 31 contacts the shoulder 62 on the inner end of the body 54 of the dimpler 50. This will occur immediately before the forward face of the piston head 20 engages the annular stop 38 at the forward end of the cylinder 14. At this point in the operation, a controlled amount of the energy of the piston 30 and piston head 20 will thus be transferred as an impulse is delivered to the dimpler 50 as the face 45 of the piston 31 strikes the shoulder 62 of the dimpler 50. This causes the dimpler head 52 to advance into the sheet material 71 to form a depression which conforms to the shape of the surface 53 on the dimpler head 52. The driving force of the piston rod 30 will however continue to contribute to the depression the dimpler 50 into the drywall material 71 very little, since, immediately after the contact between the piston face 45 and the dimpler shoulder 62, reaches the position shown in FIG. 6, where the piston head 20 contacts the stop 28 on the plate 27.

Figure 7:
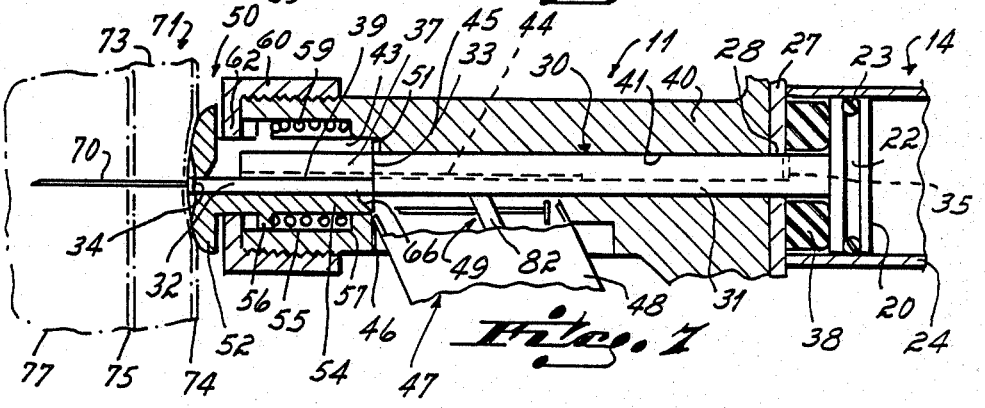
FIG. 7 is a cross-sectional side view similar to FIG. 6 illustrating the piston and plunger advanced to where a nail has been driven into the sheet material and countersunk and the dimpler has been impacted by the piston to form a surface dimple in the sheet material.

After reaching the position shown in FIG. 6, the piston head 20 is deaccellerated by the thermoelastic material of the stop 38 which is compressed between the piston head 20 and the end plate 27 at the forward end of the cylinder 14 as illustrated in FIG. 7. An absolute geometric limit to the extension of the dimpler 50 is provided by the ring 56 engaging the collar 60. This position of the dimpler 50 would be that shown in FIG. 1. However, in order to prevent damage or excessive wear and to better control the depression formed by the dimpler surface 52 in the drywall 71, the stop 38 is made sufficiently resistent to deformation so that it will not permit the piston head 20 to advance the piston rod 30 so far as to bring the ring 56 into engagement with the collar 60 under the force of the piston 31. When the piston head 20 comes to a rest against the stop 38, the nail 70 will have been fully driven into the sheet material 71 and the material 71 will have been dimpled to the configuration which is the goal of the operation. The piston rod 30 then will return to the position shown in FIG. 1. The conventional method for causing the return of the piston rod 30 is by reversal of the pneumatic pressure differential on the piston head 20. After this is completed and the plunger 32 is again in the position shown in FIG. 1, the nail feeder mechanism 48 will be pneumatically actuated to advance another nail 70A into the bore 43 to replace the nail 70 at its position.

The advantages of the present invention are realized in part by the provision for a solid impulse delivering impact between the hard metal piston 31 and the dimpler 50. The dimpler 50, of hardened metal, is short in relation to most dimplers in guns of the prior art, being located entirely at the end of the barrel 40 and having a substantial thickness in relation to its length, being only long enough to retain its alignment with the shaft 41 without subjecting the walls of the dimpler cavity 51 to excessive wear. In the preferred embodiment, the thickness of the body 54 of the dimpler 50 is between one-third and one-half its length. It has been found that with dimensions in this range, the energy associated with the impact between the face 45 of the piston 31 and the shoulder 62 of the dimpler 50 is effectively communicated to the dimpler surface 53, and that this is accomplished without subjecting the components of the apparatus 11 to excessive wear or failure rate.

The geometry of the piston 31 and its relationship to and alignment with the dimpler 50 also contributes to the advantages of the present invention. The thick and relatively massive piston 31 maintains a cross-section as large as that of the piston face 45 throughout its length. The area of the face 45 which contacts the shoulder 62 of the dimpler 50 exceeds the cross-sectional area of the plunger 32, is distributed in approximate symmetry on both sides of the plunger 32, and is approximately centered on the axis of the dimpler 50 in alignment with the center of the dimpler surface 53. Thus, the energy is effectively and uniformly delivered from the piston 31, through the dimpler 50, and into the drywall 71.

The achievement of these advantageous design features is accomplished in part by the provision of the narrowed bore 43 at the center of its cross-section along the path of the plunger 32, with the upper side of the bore 43 across from the nail feeder opening 46, to register and guide the nails through the bore 43 and the orifice 64 of the dimpler. This bore configuration is provided by the arrangement of the rail 37 in the shaft 41 to guide and maintain the alignment of the nails 70, the piston 31, the plunger 32 and the dimpler 50. This provision facilitates the location of the dimpler 50 entirely near the end of the barrel 40 and allows for the large piston face 45 and the tip 34 of the plunger 32 to be maintained remote from the dimpler 50 with the nail feed opening 46 positioned in between the dimpler 50 and the piston rod 30.

The nail and dimpler driving mechanism and nailing gun embodying the principles of the present invention having been described, what is claimed is:

1. A nailing gun having a housing, a barrel rigidly fixed to and extending longitudinally from said housing and having a fastener delivering orifice at the end thereof, a magazine for maintaining a supply of fasteners and connected to said barrel, means for feeding a fastener from said magazine into said barrel, a plunger moveable longitudinally in said barrel for driving said fastener from said barrel through said orifice, means carried by said housing for reciprocating said plunger in said barrel, and a fastener driving and dimpling apparatus comprising:

a dimpler mounted at the end of said barrel longitudinally moveable therein and having said orifice formed therethrough, a piston drivably connected at one end to said plunger reciprocating means and extending longitudinally from said housing and into and longitudinally moveable in said barrel, said plunger being fixed to and extending longitudinally from the other end of said piston in alignment with said orifice, a rail fixed to and extending longitudinally along the inside of said barrel at one side thereof and having a fastener guiding edge in longitudinal alignment with a side of said orifice, and said piston having a longitudinal channel along one side thereof, said channel having a cross section conforming to the dimensions of said rail and slidably fitted therearound.

2. The nailing gun of claim 1 wherein said dimpler has a longitudinal channel along one side thereof, said channel having a cross section conforming to the dimensions of and slidably fitted around said rail, and being in longitudinal alignment in said barrel with the channel of said piston.

3. The nailing gun of claim 1 wherein:

said piston has a retracted position in said barrel spaced from the inner end of said dimpler, and said barrel has an opening in one side thereof opposite said fastener guiding edge of said rail and between said dimpler and the retracted position of said piston for receiving a fastener from said feeding means into said barrel.

4. The nailing gun of claim 3 wherein:

said plunger has a tip which, when said piston is in said retracted position in said barrel, is spaced from the inner end of said dimpler, and said opening in said barrel is located between said dimpler and the retracted position of the tip of said plunger.

5. The nailing gun of claim 4 wherein said rail has a longitudinal groove formed in the fastener guiding edge thereof in longitudinal alignment with a side of said orifice.

6. The nailing gun of claim 5 for receiving a supply of fasteners in the form of nails collated in a strip joined by a flexible separable web wherein said plunger and said orifice have corresponding round cross sections and have a diameter approximately equal to the spacing between said groove and said opening.

7. The nailing gun of claim 4 adapted to receive a supply of fasteners collated in a strip joined by a flexible separable web wherein the tip of said plunger is slanted at an angle of approximately five degrees away from said opening.

8. The nailing gun of claim 3 wherein:

the surface of said dimpler within said barrel is tapered into the said orifice, and the tip of said plunger is slanted at an angle of approximately five degrees away from said opening.

9. The nailing gun of claim 8 adapted to receive a supply of fasteners in the form of nails collated in a strip joined by a flexible separable web and wherein said plunger and said orifice have corresponding round cross sections and have a diameter approximately equal to the spacing between said groove and said opening.

10. The nailing gun of claim 1 for receiving a supply of fasteners collated in a strip joined by a flexible separable web wherein:

said rail has a longitudinal groove in the fastener guiding edge thereof in longitudinal alignment with a side of said orifice, said piston has a retracted position in said barrel spaced from the inner end of said dimpler, and said barrel has an opening in one side thereof opposite said fastener guiding edge of said rail and between said dimpler and the retracted position of said piston for receiving a fastener from said feeding means into said barrel with said web aligned with said groove.

11. A nailing gun comprising:

a barrel having a bore extending longitudinally therethrough and having an opening in one side thereof communicating with said bore for receiving a fastener fed into said bore, a plunger moveable longitudinally in said bore, a dimpler mounted to slide longitudinally in the end of said bore and having a fastener discharge orifice extending longitudinally therethrough, said dimpler having at the outer end thereof a concave depression forming surface, and at the inner end thereof an inwardly facing impact receiving shoulder extending transverse said bore to each side said orifice for receiving a dimpler driving impulse thereagainst, a piston longitudinally slidable in said bore and having a transverse face at its end moveable from a retracted position remote from said dimpler to an extended position against said shoulder of said dimpler, said plunger being fixed to and extending longitudinally from said end of said piston and in longitudinal alignment with said orifice, the length of said plunger being approximately equal to the length of said orifice through said dimpler, the cross section of said piston conforming approximately to that of said bore, and having a central portion approximately equal to that of said plunger, a major portion of said piston face extending on the opposite sides of said plunger for impacting against said shoulder, and said opening in the side of said barrel extending between the retracted position of the tip of said plunger and the shoulder of said dimpler.

12. The nailing gun of claim 11 wherein:

said piston has an enlarged portion toward the end thereof remote from said dimpler, said gun further comprises an elastic stop fixed relative to said barrel and surrounding said piston, said stop being spaced along said piston to limit the longitudinal movement of said piston upon the impacting of said shoulder by said piston face.

13. The nailing gun of claim 11 wherein said piston and said dimpler are formed of hardened metal.

14. The nailing gun of claim 11 wherein said shoulder substantially surrounds the orifice opening at the inner end of said dimpler.

15. The nailing gun of claim 11 wherein said portion of said piston surface which extends on the opposite sides of said plunger for impacting against said shoulder, extends symmetrically on each side of said plunger.

16. The nailing gun of claim 11 wherein said portion of said piston face which extends on the opposite sides of said plunger for impacting against said shoulder extends symmetrically on each side of said plunger and is aligned with said dimpler so as to impact the shoulder of said dimpler over an extended area having a center in approximate alignment with the center of said concave outer surface of said dimpler.

17. The nailing gun of claim 11 wherein said plunger eccentrically positioned on the end of said piston and against said opening on the side of said bore.

18. The nailing gun of claim 17 wherein the wall of said bore on the side thereof opposite said opening has a longitudinal groove therein and is aligned with the edge of said orifice in said dimpler.

19. The nailing gun of claim 18 wherein the tip of said plunger is slanted at an angle of approximately five degrees away from said opening.

* * * * *